United States Patent [19]

Lieberman

[11] 4,419,787

[45] Dec. 13, 1983

[54] DOOR CLOSER ASSIST LINKAGE

[75] Inventor: Sidney Lieberman, Leola, Pa.

[73] Assignee: Dorma Door Controls Inc., Reamstown, Pa.

[21] Appl. No.: 422,000

[22] Filed: Sep. 23, 1982

Related U.S. Application Data

[63] Continuation of Ser. No. 166,334, Jul. 7, 1980, abandoned.

[51] Int. Cl.[3] ..... E05F 1/12

[52] U.S. Cl. ..... 16/65; 16/76; 16/80

[58] Field of Search ..... 16/49, 50, 65, 71, 75, 16/76, 80, 85, DIG. 10, DIG. 36

[56] References Cited

U.S. PATENT DOCUMENTS

| | | | |
|---|---|---|---|
| 184,166 | 11/1876 | Myers | 16/80 |
| 504,826 | 9/1893 | Dudley | 16/70 |
| 1,425,900 | 8/1922 | Rundell | 16/65 |
| 1,836,013 | 12/1931 | Carlson | 16/65 |
| 2,506,284 | 5/1950 | Tharp | 16/80 X |
| 2,634,454 | 4/1953 | Altenburger | 16/70 |
| 2,960,718 | 11/1960 | Lasier | 16/49 |
| 3,082,471 | 3/1963 | Rolph | 16/49 |
| 3,259,936 | 7/1966 | Sheridan | 16/85 X |
| 4,019,220 | 4/1977 | Lieberman | 16/62 |
| 4,190,926 | 3/1980 | Cronin | 16/80 X |

FOREIGN PATENT DOCUMENTS

| | | | |
|---|---|---|---|
| 132319 | 7/1902 | Fed. Rep. of Germany | 16/80 |
| 137483 | 2/1905 | Fed. Rep. of Germany | 16/80 |
| 442484 | 3/1927 | Fed. Rep. of Germany | 16/80 |
| 1157254 | 7/1969 | United Kingdom | 16/80 |

*Primary Examiner*—Fred Silverberg
*Attorney, Agent, or Firm*—Robert C. Podwil

[57] ABSTRACT

A control linkage for use with a door closer, wherein the linkage is provided with a spring which resiliently biases against relative rotation of a pair of arms as the arms approach a door-open limit position, and which aids the door closer in moving the door from the door-open limit position.

8 Claims, 6 Drawing Figures

DOOR CLOSER ASSIST LINKAGE

This application is a continuation of application Ser. No. 166,334, filed July 7, 1980, now abandoned.

BACKGROUND OF THE INVENTION

This invention relates to a door closer control and assist linkage, and more particularly, to a control linkage for use with a door closer, in which a resilient element serves to augment and assist door control forces produced by the door closer to aid in the operation of the closer.

Hydraulic door closers such as those illustrated in U.S. Pat. No. 3,082,471 to Rolph, issued Mar. 26, 1963, U.S. Pat. No. 3,259,936, to Sheridan, issued July 12, 1966, and U.S. Pat. No. 4,019,220 to Lieberman, issued Apr. 26, 1977 and assigned to the assignee of this application, are of the general type to which this invention relates. Such door closers utilize a spring-urged hydraulic piston to bias a door to its closed position, and also provide a hydraulic back-check to smoothly retard and cushion movement of the door as it approaches its extreme open position. Typically, the force generated by the door closer unit is transmitted between the unit and fixed structure such as the door frame through a linkage, generally consisting of the pair of links, pivotably coupled to the unit and to a soffit plate mounted on the door frame.

Because the internal mechanism of closer units is hydraulic, the ability of a unit to cushion back-check forces is determined by, among other factors, the configuration of its hydraulic system, the spring and hydraulic characteristics of which control the return movement of the piston, and the geometry of the linkage by which forces are transmitted between the output of the closer and the door.

A shortcoming of existing door closer apparatus is the fact that, due to both the internal structure of the closer and control arm geometry, the opening and closing forces perceived at the door are at a relatively low level when the door is at or approaching its door-open limit position.

This characteristic can be a serious drawback in certain applications, such as in exterior doors subject to heavy traffic or drafts. Many commercially available door closers units do not, in such applications, provide either a closing force adequate to overcome the retarding effect of drafts or an effective back-check.

BRIEF SUMMARY

It is therefore a general object of this invention to provide a simple mechanical device capable of augmenting closing forces at or near the extreme of movement of a door, and at the same time providing an effective back-check and positive door stop to protect the door and door control linkage from damage due to uncontrolled movement of the door at its extreme open position.

Other objects will appear hereinafter.

The foregoing in other objects are realized, in a presently preferred form of the invention, by apparatus in which a control linkage for use with a door closer comprises a first arm associated with the output shaft of a door closer, and a second arm coupled to the first arm and a suitable point of anchorage, such as the frame. It should be understood that the principles of the present invention may be applied to any of the conventional door closer mounting arrangements, including the arrangement illustrated in this application, in which the closer is mounted on the door; the so-called top jamb mounting arrangement, in which the closer is mounted on the top door jamb and the linkage coupled to the door; and the so-called parallel arm arrangement in which, when the door is in the closed position, the arms of the linkage are disposed approximately parallel to the door jamb.

In accordance with the present invention, means are provided to resiliently bias the arms against relative rotation toward their door-open limit position as the arms approach that position, but not during initial opening. Ultimately, a stop is provided to limit the arms against movement beyond the limit position. The biasing means, in the presently preferred form of the invention, is a spring which becomes operative as the arms approach their door-open limit position, and provide a force in opposition to movement toward that position until the stop member comes into play. Upon closing of the door, the energy stored in the spring aids the force provided by the closer, to positively and smoothly initiate closing of the door.

For the purpose of illustrating the invention, there is shown in the drawings a form of the invention which is presently preferred, it being understood, however, that the invention is not limited to the precise arrangements and instrumentalities shown.

DETAILED DESCRIPTION

Figure 1:
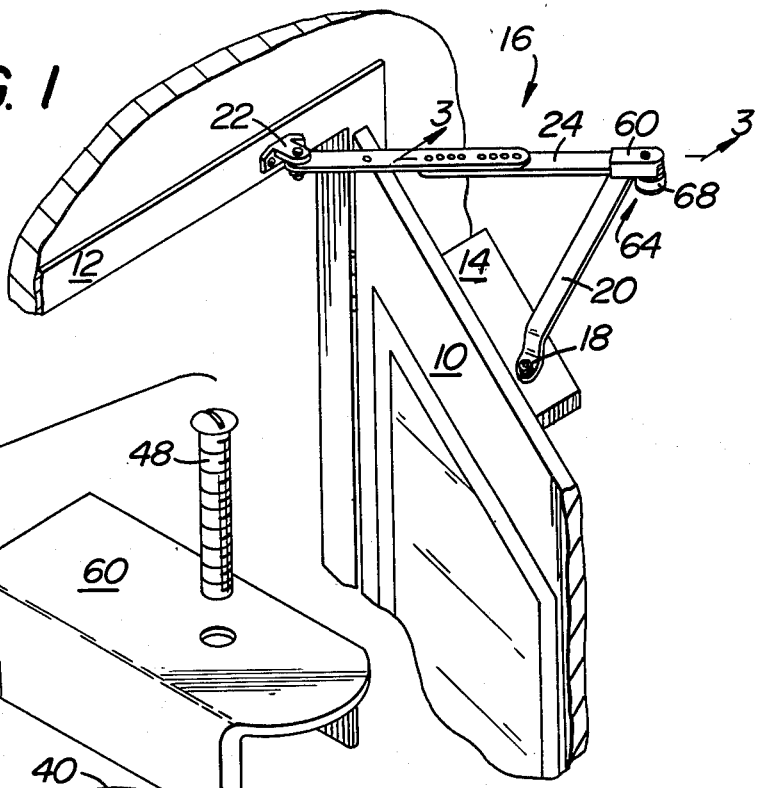
FIG. 1 is a perspective view, looking downwardly, showing the general arrangement of a door, door-opener and control linkage in accordance with the present invention.

Referring now to the drawings in detail, wherein like reference numerals designate like elements, there is seen in FIG. 1 a door designated generally by the reference numeral 10, hinged in the conventional manner to a door frame 12.

Interconnecting the door 10 and the door frame 12, and controlling movement of the door 10 with respect to the door frame 12, are a door closer 14 and a control linkage, designated generally by the reference numeral 16. In the illustrated arrangement, the closer 14 is mounted on the door 10 and one end of the control linkage 16 is pivotably coupled to the door frame 12. Those skilled in the art will recognize that other arrangements, including door frame mounting of the closer 14, are equally feasible.

As is conventional, the closer 14 has an output shaft 18, to which there is connected a first arm 20 of the control linkage 16. Pivotably coupled to the first arm 20 and to an anchorage fitting or "foot" 22 on the door frame 12 is a second arm 24 of the control linkage 16.

Figure 2:
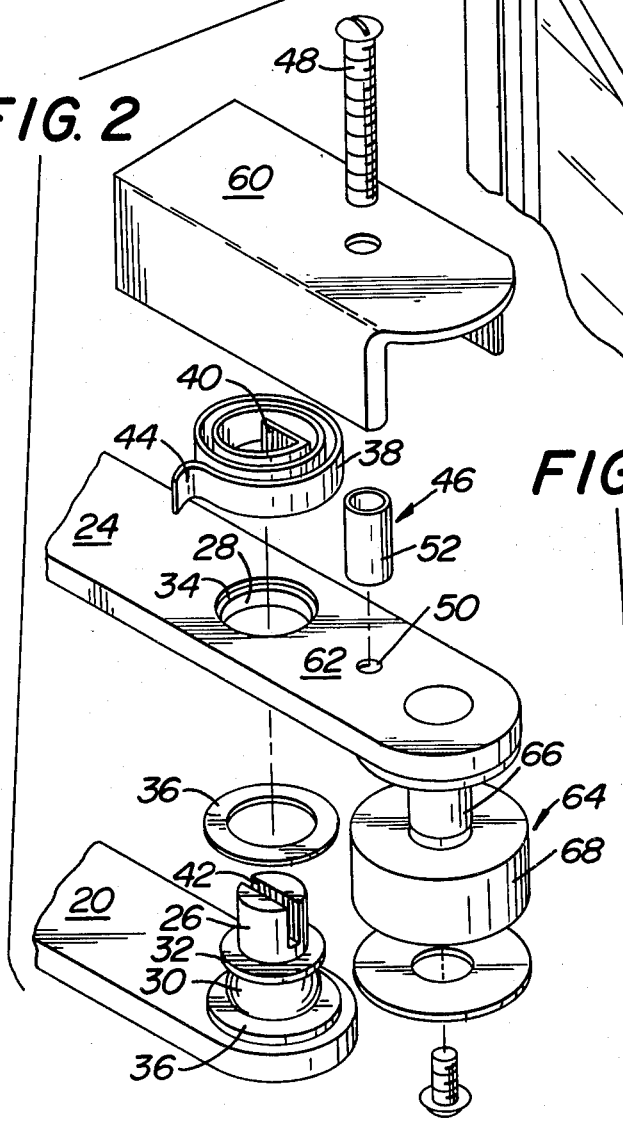
FIG. 2 is an exploded view, in perspective, showing the general arrangement of certain elements of apparatus in accordance with the present invention.
Figure 3:
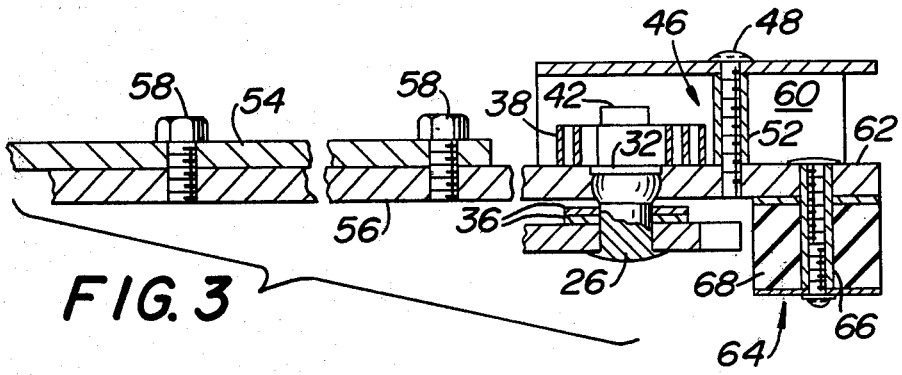
FIG. 3 is a partial cross-sectional view, taken along the line 3—3 in FIG. 1.

Referring now to FIGS. 2 and 3, it will be seen that means are provided to first resiliently bias the arms 20 and 24 against relative rotation as the arms approach a door-open limit position, and then limit the arms against movement beyond that position. A pivot pin 26 in the illustrated embodiment is affixed at one end to the arm 20, and provides a hinge between the arms 20 and 24. Thus, the arm 24 in the illustrated embodiment is provided with a bore opening 28 of a size complemental with the outer diameter of the pivot pin 26. A portion of the pivot pin 26 in the presently preferred form of the invention is an enlarged part-spherical bearing surface 30, capable of accommodating slight misalignment between the arms 20 and 24 without binding. Another portion of the pivot pin 26 is a cylindrical flange or land 32, which, when the parts are assembled, rests in a counter-bore 34 in the bore opening 28. When the pivot pin 26 is received within the bore opening 28, the pivot pin 26 and bore opening 28 define the above-mentioned hinge.

In the illustrated form of the invention, suitable washers, bushings or the like 36 may be provided in cooperation with the pivot pin 26 to facilitate relative movement of the arms 20 and 24.

Figure 4:
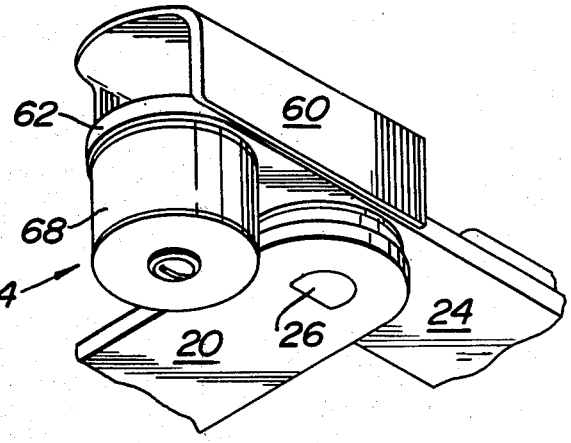
FIG. 4 is a detail view of a portion of an apparatus in accordance with the invention.

Referring to FIG. 4, the portion of the pivot pin 26 which engages the arm 20 has, in the illustrated embodiment, a "flat" surface, which engages a similarly configured opening in the arm 20 to prevent relative rotation of the pivot pin 26 and arm 20. The pivot pin 26 is riveted to arm 20 to permanently interconnect these parts.

The means for biasing the arms 20 and 24, and for aiding the door closer in closing of the door comprises, in the illustrated form of the invention, a spring member 38 anchored to the first arm 20 and so disposed as to come into engagement with the second arm 24 as the arms 20 and 24 approach their door-open limit position. To this end, the spring member 38 is a flat-wound torsion spring of the type sometimes referred to as a "brush" spring, one end 40 of which is affixed to the pivot pin 26. This is accomplished in the presently contemplated best mode of carrying out the invention by providing in the pivot pin 26 a slot 42 adapted to receive the end portion 40 of the spring 38. The spring 38 has a free end portion 44, best seen in FIG. 2, which, as will be explained later, is engageable with an abutment, designated generally by the reference numeral 46, disposed on the arm 24, as the arms 20 and 24 approach their door-open limit position. The abutment 46, in the illustrated embodiment, consists of a bolt 48, threadedly engaging threaded hole 50 in the arm 24, and a bushing 52 through which the bolt 48 passes when the various elements are assembled. The outer surface of the bushing 52 preferably complements the curvature of the free end portion 44 of the spring 38.

Figure 5:
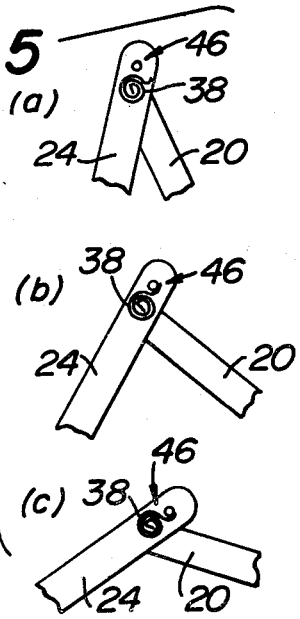
FIGS. 5*a* through 5*c* are diagrammatic views, showing the mode of operation of the resilient torsion spring in the illustrated embodiment of the present invention.

Referring now to FIGS. 5a–5c, there is seen, somewhat diagrammatically, the sequence of operation of the spring 38 as the arms 20 and 24 approach their door-open limit position. Referring to FIG. 5a, the spring 38, due to the anchorage of its end portion 40 to the pivot pin 26, initially rotates freely with the pivot pin 26 relative to the arm 24. Continued rotation, however, to the position shown in FIG. 5b, brings the free end portion 44 of the spring 38 into contact with the bushing 52. Rotation beyond the position illustrated in FIG. 5b causes deflection of the spring and application to the arms 20 and 24 of a force biasing the arms away from their door-open limit position.

Rotation of the arms 20 and 24 beyond the position shown in FIG. 5b, toward the door-open limit position shown in FIG. 5b, results in a maximum biasing force by the spring 38, which, as will be explained below, materially aids the door closer 14 in the closing of the door 10.

In a preferred form of the invention one of the arms, in this instance the arm 24, may be of variable length. For this purpose, the arm 24 is made in two pieces 54 and 56, interconnecting by screws or bolts 58.

Also in the preferred form of the invention, the spring 38 and bushing 52 are provided with a cover or housing member 60, in the form of a channel member of generally u-shaped cross-section.

As is seen in FIGS. 1, 2 and 3, when the cover member 60 is operatively disposed, its respective legs contact the upper surface of the arm 24, and it is held in place by the above mentioned bolt 48. The cover member 60 aids in holding the spring 38 in place, and also retains the spring 38 in the event of breakage.

Referring now to FIGS. 2, 3 and 4, the control linkage 16 is provided with means to limit movement of the arms 20 and 24 beyond their door-open limit position. In the preferred embodiment, the bore opening 28 in the arm 24 is disposed at a medial portion of the arm 24, so that a distal portion 62 of that arm extends beyond the pivot pin 26. An abutment means, designated generally by the reference numeral 64, is associated with the distal end portion, and comes into abutment with the arm 20 when the arms 20 and 24 approach their extreme of movement. In the illustrated form of the invention, the abutment 64 comprises a cylindrical boss 66 depending from the arm 24, surrounded by a resilient buffer 68, for actual engagement with the arm 20 when the arms 20 and 24 approach their door-open limit position. Thus, the abutment 64 provides a shock-absorbing dead stop for the arms 20 and 24.

The following table illustrates the manner in which apparatus in accordance with the present invention complements and assists the operation of a conventional door closer by providing, in a portion of the arc of movement of the door, a force assisting the door closer to close the door. The apparatus also provides as the spring deflects toward the end of the arc of movement of the door as it opens, a mechanical back-check, which supplements the hydraulic back-check of the closer (if such a feature is provided).

| Degree of Door Opening | Opening and Closing Forces Measured at 30" from Hinge Using Regular Mount: Conventional Linkage Open | Conventional Linkage Close | Disclosed Linkage Open | Disclosed Linkage Close |
|---|---|---|---|---|
| Reading Door Closer No. 614 Closer | | | | |
| 3" from latch-7° | 14.5 | 9.5 | 14.5 | 8.25 |
| 10° | 12.0 | 7.0 | 12.0 | 6.5 |
| 20° | 9.0 | 5.25 | 8.75 | 5.75 |
| 30° | 7.0 | 4.5 | 7.25 | 4.75 |
| 40° | 6.75 | 4.0 | 7.0 | 4.25 |
| 50° | 6.50 | 4.0 | 7.5 | 4.25 |
| 60° | 7.0 | 4.25 | 7.75 | 4.5 |
| 70° | 7.0 | 4.25 | 8.75 | 5.75 |
| 80° | 7.0 | 4.5 | 11.25 | 7.0 |
| 90° | 7.5 | 5.0 | 15.0 | 9.0 |
| Reading Door Closer No. 615 Closer | | | | |
| 3" from latch-7° | 22.0 | 13.0 | 19.0 | 11.0 |
| 10° | 18.0 | 11.0 | 16.5 | 9.25 |
| 20° | 12.0 | 7.0 | 11.75 | 7.25 |

-continued

| Degree of Door Opening | Opening and Closing Forces Measured at 30" from Hinge Using Regular Mount | | | |
|---|---|---|---|---|
| | Conventional Linkage | | Disclosed Linkage | |
| | Open | Close | Open | Close |
| 30° | 9.0 | 6.25 | 9.0 | 6.0 |
| 40° | 8.0 | 5.0 | 8.5 | 5.75 |
| 50° | 7.5 | 5.25 | 8.75 | 5.75 |
| 60° | 8.0 | 5.25 | 9.5 | 6.0 |
| 70° | 8.0 | 5.75 | 10.25 | 7.0 |
| 80° | 8.25 | 5.75 | 13.0 | 8.0 |
| 90° | 9.0 | 6.0 | 17.0 | 11.0 |

Figure 6:
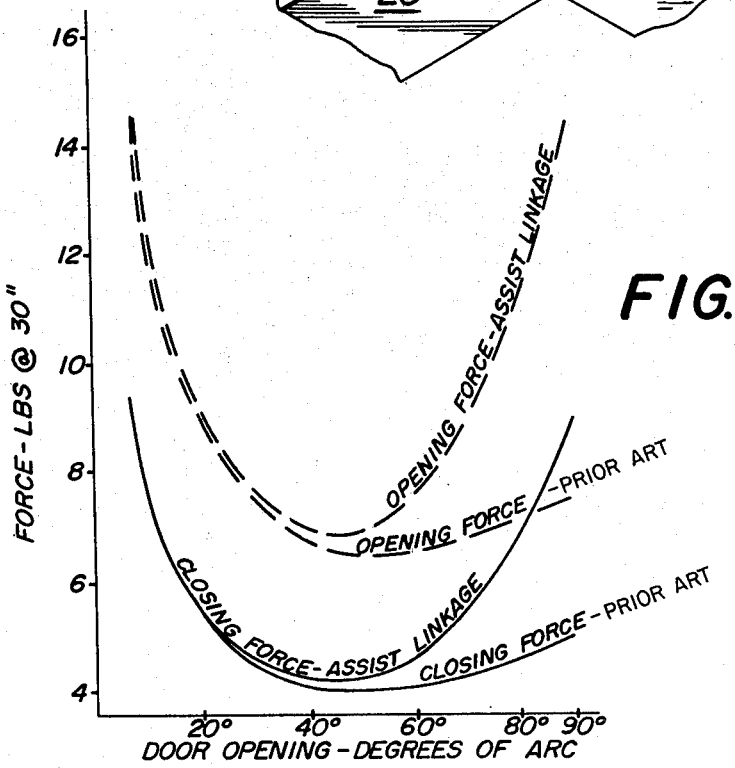
FIG. 6 is a graphic depiction of data presented in tabular form in the specification, which illustrates the effect of the apparatus of the present invention on door opening and closing forces.

The data set forth in the first table above is displayed graphically in FIG. 6, to illustrate in that manner, by comparison with conventional apparatus, the manner in which the present apparatus assists operation of a closer. As is seen in that Figure, in both opening and closing of the door, operation of the door through the first 40 degrees (40°) of arc of opening is virtually identical in both cases. At approximately 50 degrees of opening in the illustrated embodiment, the free end portion 44 of the spring 38 is contact with the abutment 46, and affects operation of the apparatus. Increased opening of the door, with consequent increased deflection of the spring 38, increases the spring force. At increased angles of opening of the door, the force attributable to the spring 38 increases, and that force is at a maximum at the 90 degree position of door opening, that is, the maximum opening of the door.

The point of spring engagement with the abutment 46, and hence the position in the arc of opening at which spring deflection begins, is, of course a variable design factor. It may be tailored to a given application by design or selection of the spring 38 and the position of the abutment 46.

It will be seen from FIG. 6, and recognized from the above tabular data, that the effect of the apparatus 16 on the operation of the closer 14 precisely complements and compensates for the shortcomings of conventional door closers. As is evident from FIG. 6, the closing force provided by conventional closers at their extremes of opening is relatively weak, far less in any event than the force presented upon initial opening of the door. In some environments, the relative weakness of the door closer at the extreme of opening is an impediment to full and proper closing of the door, and such a shortcoming may be overcome at least in part by use of the present invention. Similarly, in the opening case, where a back-checking action is desirable, the present invention provides, in the last part of the arc of movement of the door enhanced resistance to opening, thus providing, in effect, a helpful highly desirable mechanical back-check.

The present invention may be embodied in other specific forms without departing from its spirit or essential attributes, and, accordingly, reference should be made to the appended claims rather than the foregoing specification as indicating a scope of the invention.

I claim:

1. A control linkage for use with a door closer and a door for transmitting force therebetween, the door closer being mounted on one of a door or a frame and the distal end of said control linkage being connected to a point of anchorage on the other of said door or frame, said control linkage having a door open limit position and comprising a first elongated arm connected to the output shaft of the door closer, a second elongated arm pivotably coupled to said first arm and having one end thereof pivotably coupled to said point of anchorage, and means interconnecting said arms to first resiliently bias said arms against relative rotation toward said door-open limit position as said arms approach said position and then limit said arms against movement beyond said position, said means interconnecting said arms comprising resilient biasing means coupled to one of said arms and adapted to come into force-transmitting engagement with the other of said arms only when said control linkage approaches said door open limit position, said resilient biasing means providing a force in opposition to movement of said arms toward said door-open limit position, and a dead stop member coupled to said other arm for engagement with said one of said arms when said control linkage is in said door-open limit position, said resilient biasing means being so configured and arranged as to provide a bias for said arms and the door away from the door-open limit position to aid the closer in closing the door, said resilient biasing means comprising a spring member anchored to said one of said arms, said spring member being a torsion spring having one end thereof fixedly coupled to said one of said arms, an abutment disposed on the other of said arms, and said spring member having a free end thereof which contacts said abutment only when said control linkage approaches said door open limit position, and hinge means pivotably interconnecting said arms, said hinge means comprising a pivot pin having one end thereof affixed to said one of said arms, said other of said arms being pivotably received on said pivot pin, and said one end of said spring member being non-rotatably affixed to said pivot pin.

2. Apparatus in accordance with claim 1, wherein said torsion spring is a flat wound torsion spring.

3. Apparatus in accordance with claim 2, said hinge means engaging said other of said arms at a medial portion of said other arm, whereby a distal end portion of said other arm extends beyond said hinge means, said another abutment being disposed on said distal end portion.

4. Apparatus in accordance with claim 3, and a cover member adapted to enclose said spring, fastener means for coupling said cover member to said other of said arms, and said fastener means providing said abutment for contact by said free end of said spring.

5. Apparatus in accordance with claim 4, wherein said cover member comprises a channel member of generally U-shaped cross-section, respective legs of said channel member adapted to contact the surface of said other arm when said cover member is operatively disposed, and said fastener means being an elongated member threadedly engageable with said one arm.

6. Apparatus in accordance with claim 2, wherein said spring member comes into force-transmitting engagement with said other arm only when the door has been opened through about forty degrees (40°) of arc.

7. Apparatus in accordance with claim 1, and a slot on said pivot pin, said one end of said torsion spring being received in said slot, and said dead stop member comprising another abutment affixed to said other of said arms and extending into the path of movement of said one of said arms.

8. Apparatus in accordance with claim 7, wherein said another abutment comprises a rigid member affixed to said other of said arms, and resilient buffer means affixed to said rigid member.

* * * * *